US011150593B1

(12) United States Patent
Arai

(10) Patent No.: US 11,150,593 B1
(45) Date of Patent: Oct. 19, 2021

(54) IMAGE FORMING APPARATUS CAPABLE OF SUPRESSING TONER REMAINING IN AN OUTER REGION OF A PHOTOCONDUCTOR

(71) Applicant: Konica Minolta, Inc., Tokyo (JP)

(72) Inventor: Junichi Arai, Toyokawa (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 17/193,714

(22) Filed: Mar. 5, 2021

(30) Foreign Application Priority Data

Apr. 1, 2020 (JP) ..... JP2020-065722

(51) Int. Cl.
*G03G 15/00* (2006.01)
*G03G 15/02* (2006.01)
*G03G 21/00* (2006.01)
*G03G 15/09* (2006.01)

(52) U.S. Cl.
CPC ..... *G03G 21/0017* (2013.01); *G03G 15/0225* (2013.01); *G03G 15/0266* (2013.01); *G03G 15/0907* (2013.01); *G03G 15/0935* (2013.01); *G03G 15/5008* (2013.01); *G03G 15/5016* (2013.01); *G03G 21/0094* (2013.01)

(58) Field of Classification Search
CPC ..... G03G 15/0266; G03G 15/5008; G03G 15/5016; G03G 21/0094
USPC ..... 399/50, 81, 167, 346
See application file for complete search history.

(56) References Cited

U.S. PATENT DOCUMENTS 7,970,303 B2 * 6/2011 Yamada ..... G03G 21/0011 399/50
10,908,554 B2 * 2/2021 Ishii ..... G03G 15/0266
2020/0393785 A1 * 12/2020 Haga et al. ..... G03G 15/5016

FOREIGN PATENT DOCUMENTS

JP 2005181713 A 7/2005

* cited by examiner

*Primary Examiner* — William J Royer
(74) *Attorney, Agent, or Firm* — Osha Bergman Watanabe & Burton LLP

(57) ABSTRACT

An image forming apparatus includes: a photoconductor; a charging roller; an exposure device; a developing device that is provided on a downstream side of the charging roller in a rotation direction of the photoconductor, and forms a toner image by supplying toner to a latent image; a cleaning blade that is provided between a transfer part of a surface of the photoconductor located on a downstream side of the developing device in the rotation direction of the photoconductor and the charging roller, and removes residual toner adhering to a part of the surface of the photoconductor on a downstream side of the transfer part; a lubricant supplier that supplies a lubricant to the surface of the photoconductor; and a voltage controller that controls a charging voltage to be applied to the charging roller.

6 Claims, 9 Drawing Sheets

IMAGE FORMING APPARATUS CAPABLE OF SUPRESSING TONER REMAINING IN AN OUTER REGION OF A PHOTOCONDUCTOR

The entire disclosure of Japanese patent Application No. 2020-065722, filed on Apr. 1, 2020, is incorporated herein by reference in its entirety.

BACKGROUND

Technological Field

This disclosure relates to an image forming apparatus.

Description of the Related Art

In the related art, an image forming apparatus including a cleaning blade that removes toner remaining on a surface of a photoconductor has been known. In such an image forming apparatus, when a length of the cleaning blade is longer than a development region formed on the photoconductor (a region in which a toner image is formed by a developing device), a frictional force increases between an outer region of the development region on the surface of the photoconductor and the cleaning blade. By doing this, the cleaning blade is turned over.

For example, an image forming apparatus described in JP 2005-181713 A is known as an image forming apparatus that solves the above problems. In this image forming apparatus, a developer sealing member that prevents leakage of a developer from an end of a development carrier (developing roller) is disposed so as to abut on the development carrier, and a lubricant is applied to the developer sealing member. Thus, the lubricant is supplied to the photoconductor via the development carrier. Accordingly, the frictional force generated between the outer region of the development region of the surface of the photoconductor and the cleaning blade is reduced.

In the image forming apparatus described in P 2005-181713 A, there is a concern that a lubricant film is formed on the outer region of the surface of the photoconductor by excessively supplying the lubricant to the photoconductor, especially at an initial stage of use. In this case, since a potential of the outer region is lowered, the toner remains in this region. As a result, there is a concern that toner remaining in the outer region adheres to a sheet by supplying a sheet having a size directly coming into contact with both the development region and the outer region or having a size indirectly coming into contact with both the development region and the outer region via a transfer device or the like.

SUMMARY

An object of the present disclosure is to provide an image forming apparatus capable of suppressing the remaining of toner in an outer region of a surface of a photoconductor.

To achieve the abovementioned object, according to an aspect of the present invention, an image forming apparatus reflecting one aspect of the present invention comprises: a photoconductor that is rotatable around a rotation shaft; a charging roller that is disposed so as to be in contact with a surface of the photoconductor, and charges the surface of the photoconductor; an exposure device that forms a latent image by exposing an exposure part of the surface of the photoconductor located on a downstream side of the charging roller in a rotation direction of the photoconductor; a developing device that is provided on the downstream side of the charging roller in the rotation direction of the photoconductor, and forms a toner image by supplying toner to the latent image; a cleaning blade that is provided between a transfer part of the surface of the photoconductor located on a downstream side of the developing device in the rotation direction of the photoconductor and the charging roller, and removes the residual toner adhering to a part of the surface of the photoconductor on a downstream side of the transfer part; a lubricant supplier that supplies a lubricant to the surface of the photoconductor; and a voltage controller that controls a charging voltage to be applied to the charging roller, wherein the surface of the photoconductor has a development region in which the toner image is formed by the developing device and an outer region located outside of the development region in an axial direction of the rotation shaft, the cleaning blade has an inner contact part that is in contact with the development region and an outer contact part that is in contact with the outer region, the lubricant supplier is capable of supplying the lubricant to at least a part of the outer region, and the voltage controller sets an applied voltage value that is an absolute value of the charging voltage to be applied to the charging roller when a sheet has a size coming into contact with the development region and the outer region to be larger than a reference voltage value that is an absolute value of the charging voltage to be applied to the charging roller when the sheet has a size coming into contact only with the development region.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention:

FIG. 6 is a diagram schematically illustrating a configuration of a voltage controller, a drive controller, an operation panel, and the like;

DETAILED DESCRIPTION OF EMBODIMENTS

Figure 1:
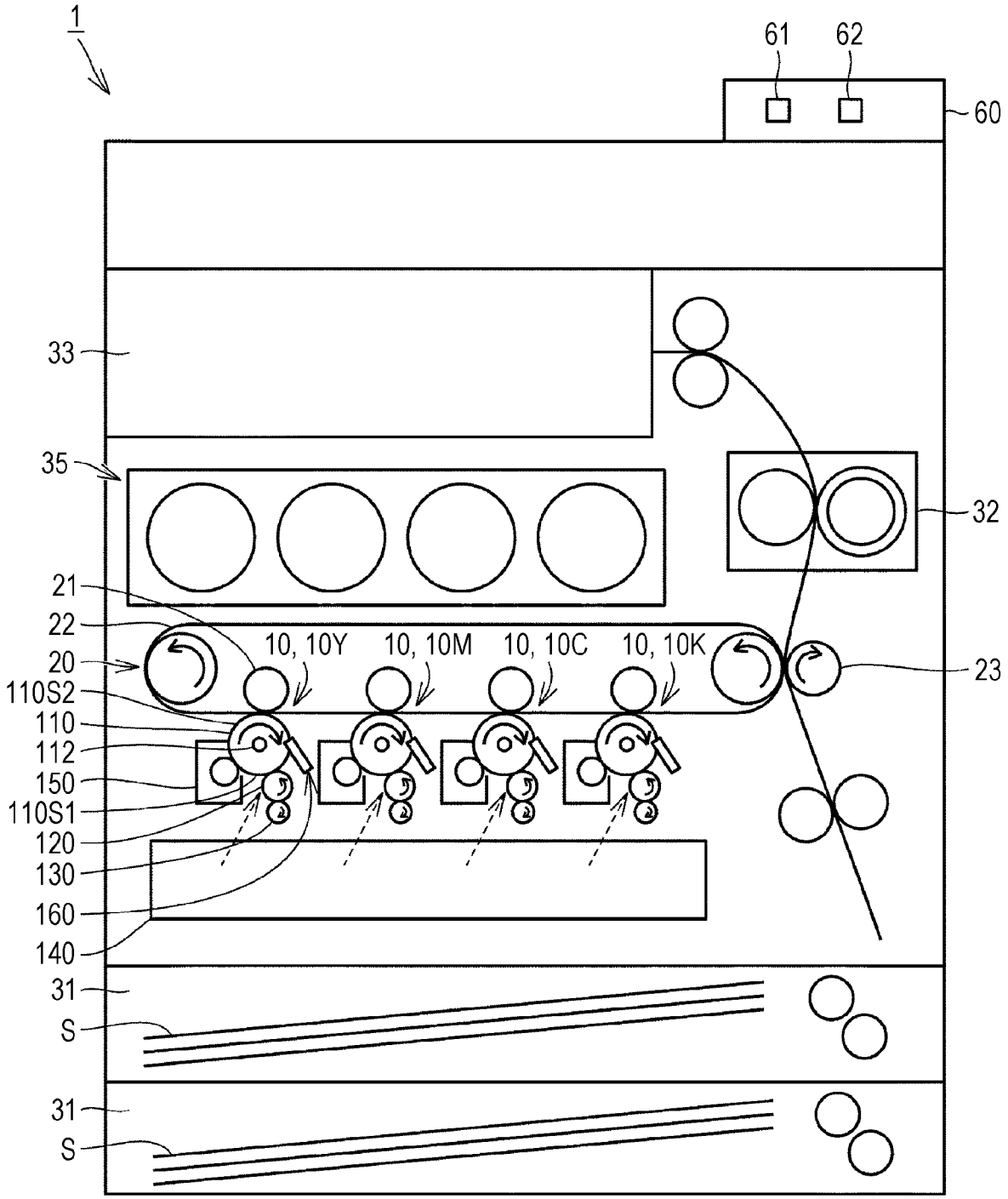
FIG. 1 is a diagram schematically illustrating an overall configuration of an image forming apparatus according to an embodiment of the present disclosure.
Figure 2:
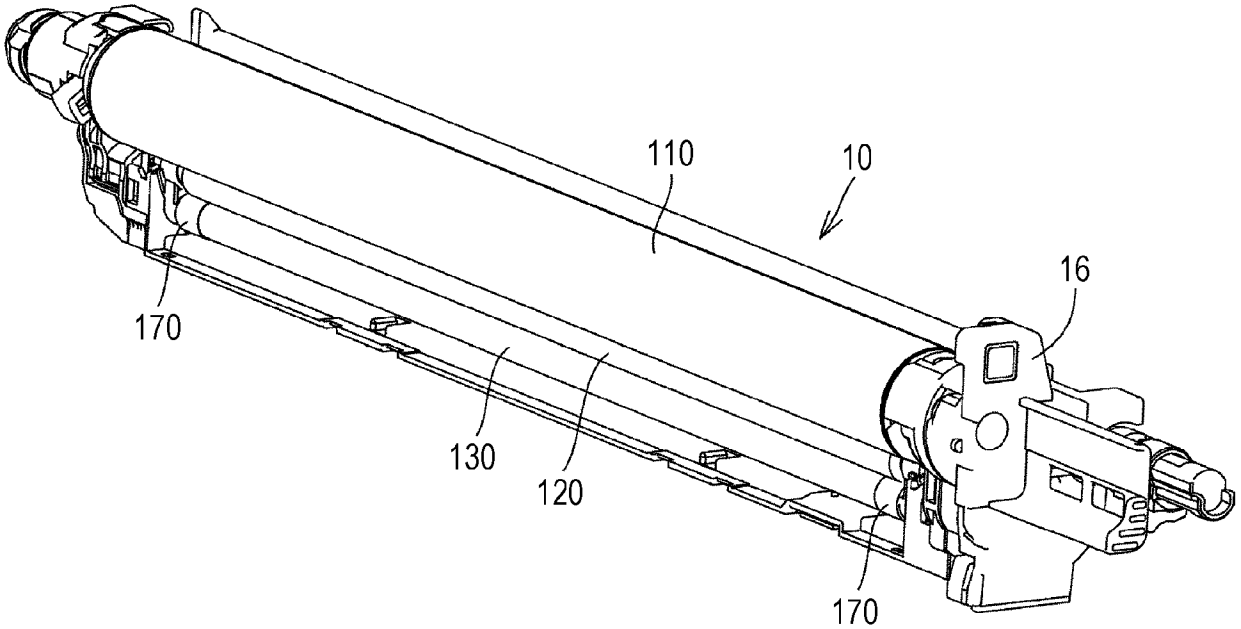
FIG. 2 is a diagram schematically illustrating a part of an image forming part.

Hereinafter, one or more embodiments of the present invention will be described with reference to the drawings. However, the scope of the invention is not limited to the disclosed embodiments. In the drawings referred to below, the same or corresponding members are given the same number.

FIG. 1 is a schematic diagram illustrating an overall configuration of an image forming apparatus 1 according to an embodiment of the present invention. The image forming apparatus is a Multifunctional Peripheral (MFP) having a plurality of functions such as a copy function, a facsimile function, a printer function, and a scanner function.

As illustrated in FIG. 1, the image forming apparatus 1 includes image forming parts 10 (10Y, 10M, 10C, and 10K), a transfer device 20, sheet feed trays 31, a fixing device 32, a sheet ejection tray 33, and a toner replenishment device 35.

The image forming parts 10 are parts that form toner images (images) to be transferred to the transfer device 20. The image forming part 10Y, the image forming part 10M, the image forming part 10C, and the image forming part 10K forms toner images having colors of yellow (Y), magenta (M), cyan (C), and black (K) on the transfer device 20, respectively. The details of the image forming parts 10 will be described later.

The transfer device 20 includes a primary transfer roller 21, an intermediate transfer belt 22, and a secondary transfer roller 23. The toner images of the colors formed by the image forming parts 10 are superposed on a surface of the intermediate transfer belt 22. Thereafter, the intermediate transfer belt 22 conveys the color toner images to a secondary transfer part formed between the intermediate transfer belt 22 and the secondary transfer roller 23.

The sheet feed trays 31 are provided as storages that store sheets S as recording media. A plurality of sheets S is stored in the sheet feed trays 31. In the present embodiment, the sheet feed trays 31 are provided in two stages in an up-down direction. However, one or three or more sheet feed trays 31 may be provided in the up-down direction.

The sheet S housed in the sheet feed tray 31 is conveyed to the secondary transfer part between the intermediate transfer belt 22 and the secondary transfer roller 23 by various rotating rollers. The color toner image supported on the intermediate transfer belt 22 is transferred to a surface of the sheet S at the secondary transfer part. The color toner image is fixed on the surface of the sheet S by the fixing device 32. The sheet S on which the image is formed by the above steps is ejected to the sheet ejection tray 33.

The toner replenishment device 35 is a device that supplies toner (developer) to a developing device 150 of the image forming part 10. This toner contains a treatment agent (lubricant, abrasive, or the like) in order to extend a lifespan of a photoconductor 110. The toner replenishment device 35 is provided between the intermediate transfer belt 22 and the sheet ejection tray 33 in a vertical direction. However, the arrangement of the toner replenishment device 35 in the image forming apparatus 1 is not particularly limited.

Here, the image forming part 10 will be described. As illustrated in FIGS. 1 to 4, the image forming part 10 includes a housing 16, the photoconductor 110, a charging roller 120, a cleaning roller 130, an exposure device 140, a developing device 150, and a cleaning blade 160, and lubricant suppliers 170.

The photoconductor 110 is rotatable around a rotation shaft 112. The surface of the photoconductor 110 constitutes a photosensitive layer that rotates in response to the rotation of the rotation shaft 112.

Figure 3:
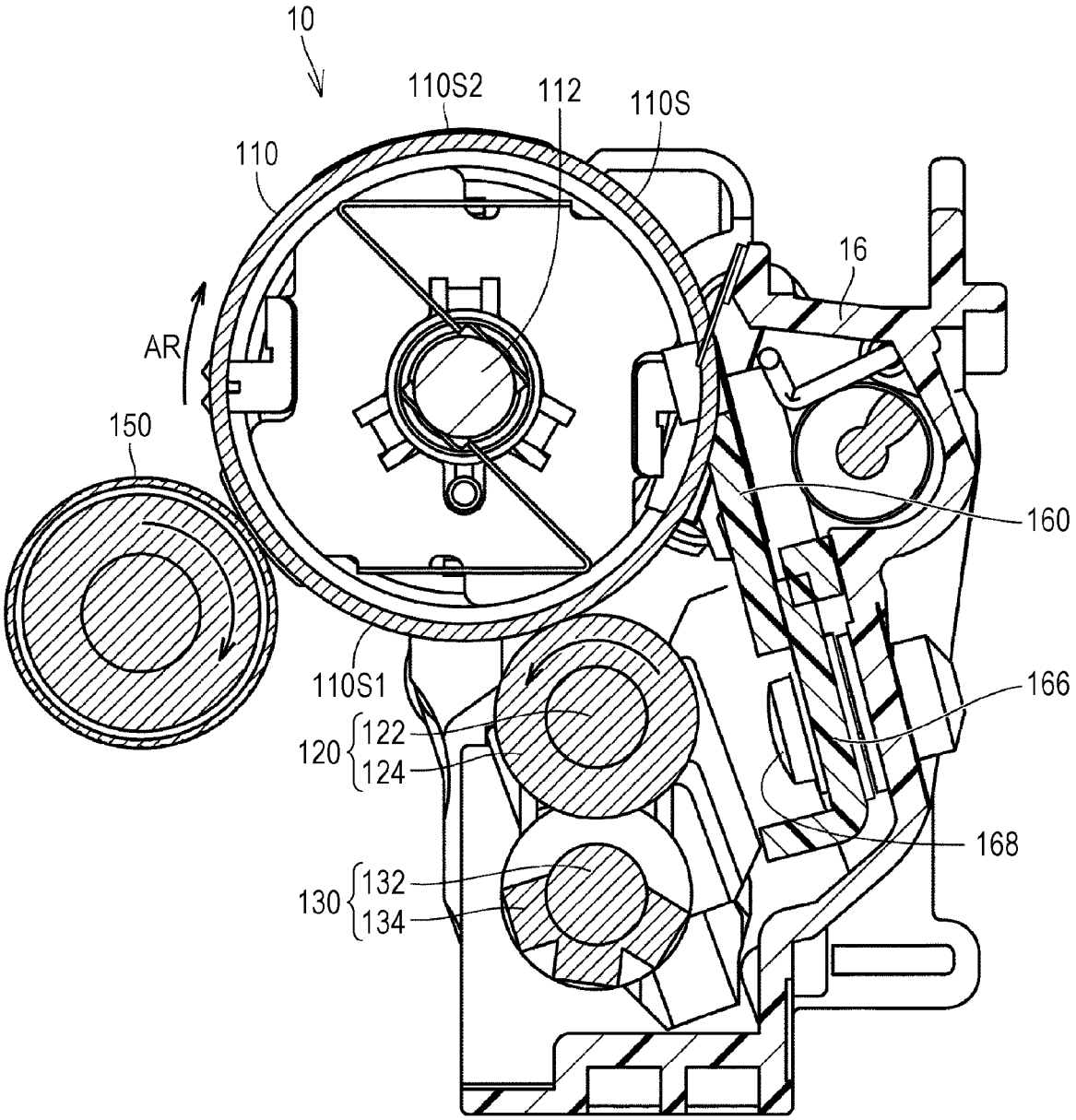
FIG. 3 is a sectional view of the image forming part.
Figure 4:
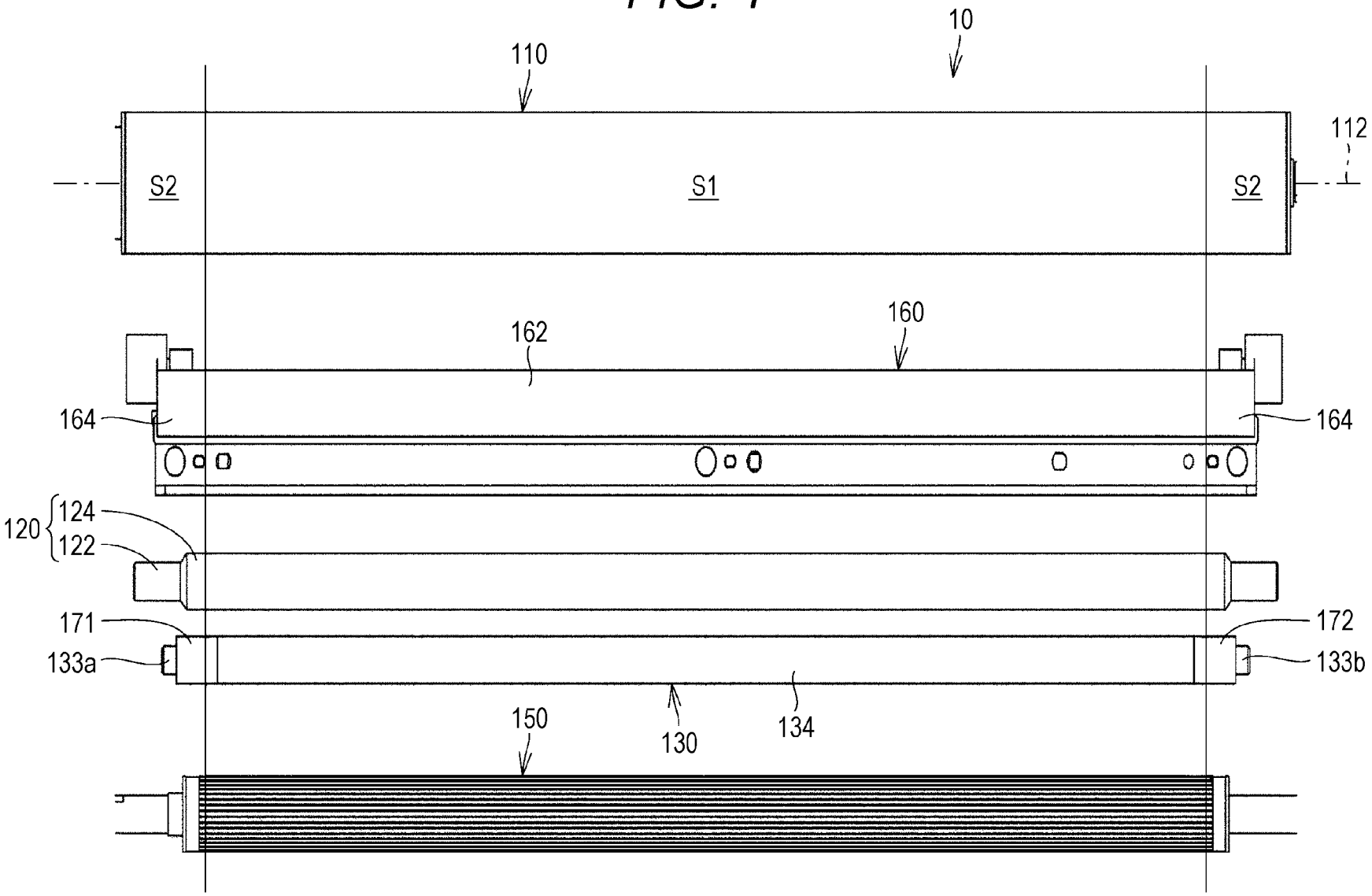
FIG. 4 is a diagram illustrating an arrangement relationship between the image forming parts.

The charging roller 120 charges a surface 110S (see FIG. 3) of the photoconductor 110 to a predetermined potential. The charging roller 120 is disposed so as to be in contact with the surface 110S of the photoconductor 110. As illustrated in FIGS. 3 and 4, the charging roller 120 has a support shaft 122 and a charging layer 124.

The support shaft 122 is disposed in a posture parallel to the rotation shaft 112 of the photoconductor 110. The support shaft 122 is made of metal or the like.

The charging layer 124 is attached to the support shaft 122. The charging layer 124 is disposed so as to be in contact with the surface 110S of the photoconductor 110. The charging layer 124 rotates in accordance with the rotation of the photoconductor 110. The charging layer 124 is made of solid rubber or the like.

Figure 5:
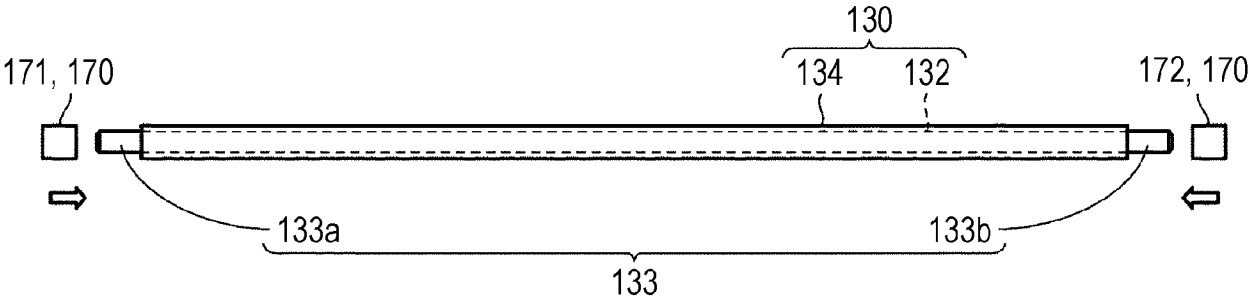
FIG. 5 is a diagram schematically illustrating a relationship between a cleaning roller and a lubricant supplier.

The cleaning roller 130 cleans the charging roller 120. The cleaning roller 130 is disposed so as to be in contact with a surface of the charging roller 120. As illustrated in FIGS. 3 and 5, the cleaning roller 130 has a support shaft 132 and a cleaning layer 134.

The support shaft 132 is disposed in a posture parallel to the support shaft 122 of the charging roller 120. The support shaft 132 is made of metal or the like.

The cleaning layer 134 is attached to the support shaft 132. The cleaning layer 134 is disposed so as to be in contact with a surface of the charging layer 124 at a predetermined pressure. The cleaning layer 134 rotates in accordance with the rotation of the charging layer 124. The cleaning layer 134 is made of, for example, a foam material (foam rubber or the like).

As illustrated in FIG. 5, the support shaft 132 of the cleaning roller 130 has a protrusion 133 that protrudes outward from the cleaning layer 134 in an axial direction of the support shaft 132. The protrusion 133 has a first protrusion 133*a* protruding from one end of the support shaft 132, and a second protrusion 133*b* protruding from the other end of the support shaft 132.

The exposure device 140 forms a latent image by exposing an exposure part 110S1 (see FIGS. 1 and 3) of the surface 110S of the photoconductor 110 which is located on a downstream side of the charging roller 120 in a rotation direction of the photoconductor 110 (by irradiating the exposure part with laser or the like). In the present embodiment, the exposure device 140 is disposed below the photoconductor 110.

The developing device 150 is provided on the downstream side of the charging roller 120 in the rotation direction of the photoconductor 110. The developing device 150 forms the toner image by supplying toner to the latent image. This toner image is transferred to the transfer device 20 at a transfer part 110S2 (see FIGS. 1 and 3) of the surface 110S of the photoconductor 110 which is located on a downstream side of the developing device 150 in the rotation direction of the photoconductor 110. In the present embodiment, a developing roller is used as the developing device 150.

The housing 16 holds the photoconductor 110, the charging roller 120, the cleaning roller 130, the cleaning blade 160, and the lubricant supplier 170. The housing 16 has a shape that exposes the exposure part 110S1 and the transfer part 110S2 of the photoconductor 110.

FIG. 4 illustrates a region of the surface 110S of the photoconductor 110 on which the toner image is formed by the developing device 150 (hereinafter, referred to as a "development region S1") and regions of the surface 110S of the photoconductor 110 located outside of the development region S1 in the axial direction of the rotation shaft 112 (hereinafter, referred to as "outer regions S2"). A width of the cleaning layer 134 in a direction parallel to the axial direction of the rotation shaft 112 is set to be equal to or slightly smaller than a width of the development region S1 in the same direction. That is, the protrusion 133 of the support shaft 132 protrudes outward from the development region S1 in the direction parallel to the axial direction of the rotation shaft 112.

The cleaning blade 160 is provided between the transfer part 110S2 and the charging roller 120 in the rotation direction of the photoconductor 110. The cleaning blade 160 removes residual toner adhering to a part of the surface 110S of the photoconductor 110 on the downstream side of the transfer part 110S2. The cleaning blade 160 is formed in a plate shape. The cleaning blade 160 has a shape extending along the axial direction of the rotation shaft 112. The cleaning blade 160 is made of, for example, a resin material such as urethane. As illustrated in FIG. 3, the cleaning blade 160 is fixed to the housing 16 by a support member 166 and a fixing member 168. As illustrated in FIG. 4, the cleaning blade 160 has an inner contact part 162 and outer contact parts 164.

The inner contact part 162 is a part of the surface 110S of the photoconductor 110 that is in contact with the development region S1. The outer contact parts 164 are parts in contact with the outer regions S2 of the surface 110S of the photoconductor 110. That is, a length of the cleaning blade 160 in the axial direction of the rotation shaft 112 is set longer than the length of the development region S1 in the axial direction of the rotation shaft 112.

The lubricant supplier 170 supplies a lubricant to the surface 110S of the photoconductor 110. Specifically, the lubricant supplier 170 supplies the lubricant to at least a part of the outer region S2 of the surface 110S of the photoconductor 110 in contact with the outer contact part 164.

In the present embodiment, the lubricant supplier 170 is attached to the protrusion 133 of the support shaft 132 of the cleaning roller 130 as illustrated in FIG. 5. That is, the lubricant supplier 170 is disposed so as to be indirectly in contact with the outer region S2 with the charging roller 120 interposed therebetween. The lubricant supplier 170 supplies the lubricant to a part of the outer region S2 while rotating in response to the rotation of the photoconductor 110. The lubricant supplier 170 has a first supplier 171 attached to the first protrusion 133*a* and a second supplier 172 attached to the second protrusion 133*b*.

As illustrated in FIG. 4, it is preferable that the lubricant suppliers 170 are arranged at locations overlapping outer edges of the development region S1 in a direction orthogonal to the axial direction of the rotation shaft 112. The lubricant supplier 170 may supply the lubricant over the entire outer region S2.

The lubricant supplier 170 is a member different from the cleaning layer 134. The lubricant supplier 170 includes a retainment member and a lubricant.

The retainment member is a member capable of retaining the lubricant. It is preferable that the retainment member is made of a foam material (foam rubber, urethane foam, or the like), felt, a blanket, or the like. In the present embodiment, the retainment member is formed in a cylindrical shape and is attached to each of the protrusions 133*a* and 133*b*. It is preferable that an inner diameter of the retainment member is set to be slightly smaller than an outer diameter of each of the protrusions 133*a* and 133*b*. It is preferable that an outer diameter of the retainment member is set to be equal to an outer diameter of the cleaning layer 134 or a size based on the amount of deformation when pressure-contacted with the charging roller 120.

The retainment member may be formed integrally with the cleaning layer 134 by using the same material as the cleaning layer 134. In this case, in order to prevent the cleaning layer 134 from being impregnated with the lubricant, it is preferable that a notch is provided at a boundary between the cleaning layer 134 and the lubricant supplier 170. It is more preferable that a sheet (polyester film or the like) that prohibits the passage of the lubricant is disposed in the notch.

The lubricant is retained in the retainment member. Examples of the lubricant include fluorine oil, molybdenum, graphite, and the like.

Figure 6:
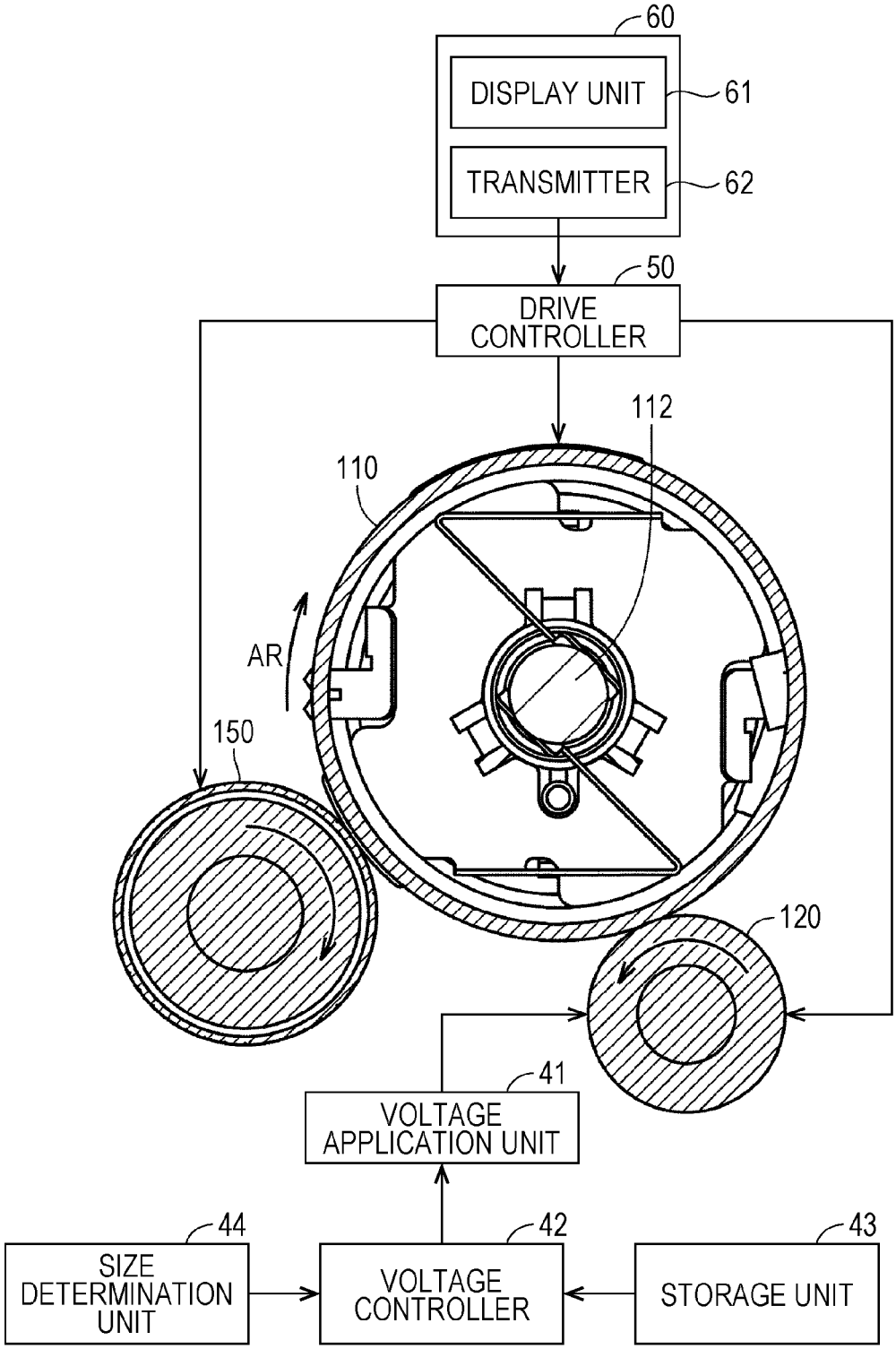

As illustrated in FIG. 6, the image forming apparatus 1 of the present embodiment further includes a voltage application unit 41, a voltage controller 42, a storage unit 43, a size determination unit 44, a drive controller 50, and an operation panel 60.

The voltage application unit 41 applies a charging voltage to the charging roller 120.

The voltage controller 42 controls the charging voltage to be applied to the charging roller 120. Specifically, the voltage controller 42 controls the charging voltage to be applied to the charging roller 120 by the voltage application unit 41. That is, the voltage application unit 41 applies the charging voltage instructed by the voltage controller 42 to the charging roller 120.

The voltage controller 42 sets an applied voltage value V which is an absolute value of the charging voltage to be applied to the charging roller 120 when the sheet S has a size coming into contact with the development region S1 and the outer region S2 to be larger than a reference voltage value which is an absolute value of the charging voltage to be applied to the charging roller 120 when the sheet S has a size coming into contact only with the development region S1.

Specifically, the voltage controller 42 changes the applied voltage value V to a set voltage value V1 which is an absolute value larger than the reference voltage value when the sheet S has the size coming into contact with the development region S1 and the outer region S2 and when a cumulative value of the number of printed sheets of the sheet S or a cumulative value of the number of times of rotations of the photoconductor 110 is equal to or less than a set value. The set value is set to, for example, 1000 sheets. The set voltage value V1 is set to, for example, +30 V.

The voltage controller 42 changes the applied voltage value V to a specified voltage value V2 which is an absolute value larger than the set voltage value V1 when the sheet S has the size coming into contact with the development region S1 and the outer region S2 and the cumulative value of the number of printed sheets of the sheet S or the cumulative value of the number of times of rotations of the photoconductor 110 is equal to or less than a specified value smaller than the set value. The specified value is set to, for example, 500 sheets. The specified voltage value V2 is set to, for example, +50 V.

The voltage controller 42 does not control the applied voltage value V when the sheet S has the size coming into contact only with the development region S1.

The storage unit 43 stores the cumulative value of the number of printed sheets of the sheet S. The storage unit 43 sends the cumulative value to the voltage controller 42. The storage unit 43 may store the cumulative value of the number of times of rotations of the photoconductor 110 and may send the cumulative value to the voltage controller 42.

The size determination unit 44 determines the size of the sheet S to be sent to the image forming part 10. Specifically, the size determination unit 44 determines whether the sheet S has the size coming into contact with the development region S1 and the outer region S2, or the sheet S has the size coming into contact only with the development region S1, and sends the determination result to the voltage controller 42. The sheet S may come into directly contact with the development region S1 and the outer regions S2, or may come into indirectly contact with the development region S1 and the outer regions S2 with the transfer device 20 interposed therebetween.

Figure 7:
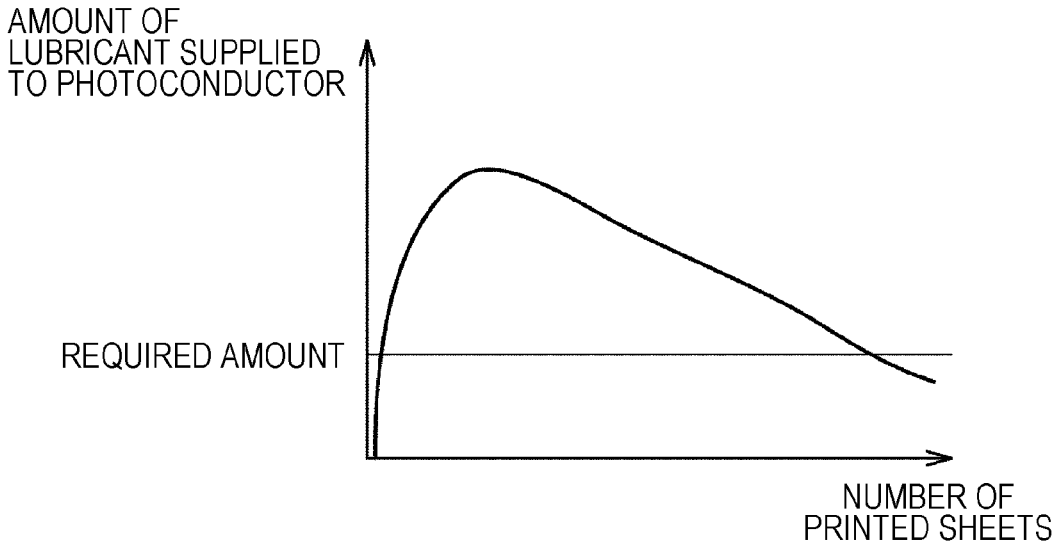
FIG. 7 is a graph showing a relationship between the number of printed sheets and the amount of lubricant supplied to a photoconductor.

Here, the transition of the amount of lubricant supplied from the lubricant supplier 170 with an increase in the number of printed sheets of the sheet S will be described with reference to FIG. 7. As illustrated in FIG. 7, the amount of supplied lubricant becomes larger than a required amount at an initial stage of use of the image forming apparatus 1. Thus, a lubricant film may be formed in the outer region S2 especially at the initial stage of use. When the film is formed in the outer region S2, since a potential of the outer region S2 decreases, toner remains in the outer region S2. The voltage controller 42 enables the suppression of the remaining of the toner in the outer region S2.

Figure 8:
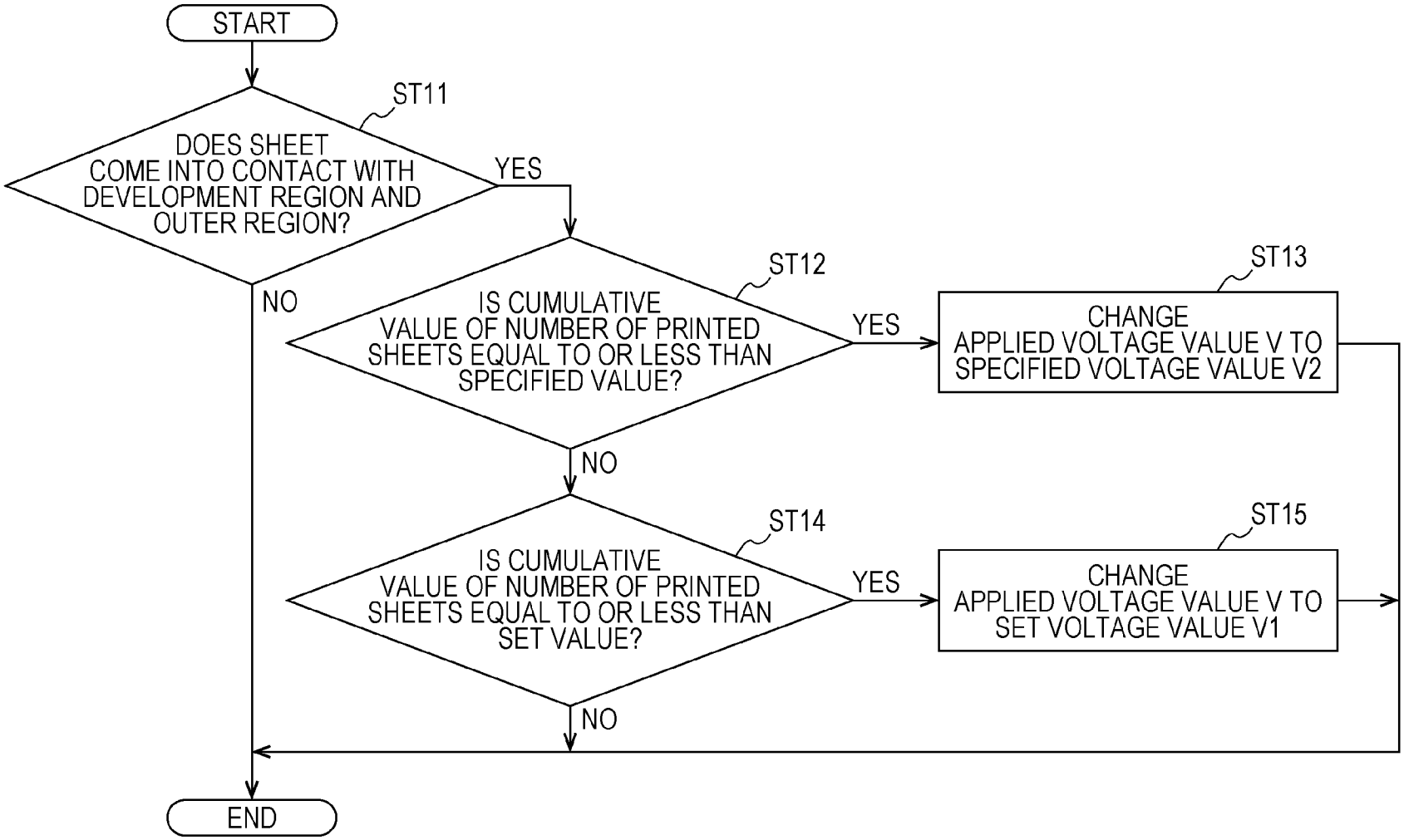
FIG. 8 is a flowchart illustrating control contents of the voltage controller.

A control flow of the voltage controller 42 will be described with reference to FIG. 8.

When printing on the sheet S is instructed, the size determination unit 44 first determines whether the sheet S has the size coming into contact with both the development region S1 and the outer region S2 (step ST11).

As a result, when the sheet S does not have the size coming into contact with both the development region S1 and the outer region S2 (NO in step ST11), that is, when the sheet S has the size coming into contact only with the development region S1, the voltage controller 42 does not control the applied voltage value V.

On the other hand, when the sheet S has the size coming into contact with both the development region S1 and the outer region S2, the voltage controller 42 determines whether the cumulative value received from the storage unit 43 is equal to or less than the specified value (for example, 500 sheets) (step ST12).

When the cumulative value is equal to or less than the specified value, the voltage controller 42 changes the applied voltage value V to the specified voltage value V2 (for example, +50 V) (step ST13). Accordingly, the absolute value of the charging voltage to be applied to the charging roller 120 by the voltage application unit 41 becomes large.

On the other hand, when the cumulative value is larger than the specified value (NO in step ST12), the voltage controller 42 determines whether the cumulative value received from the storage unit 43 is equal to or less than the set value (for example, 1000 sheets) larger than the specified value (step ST14).

As a result, when the cumulative value is equal to or less than the set value, the voltage controller 42 changes the applied voltage value V to the set voltage value V1 (for example, +30 V) smaller than the specified voltage value V2 (step ST15). Accordingly, the absolute value of the charging voltage to be applied to the charging roller 120 by the voltage application unit 41 becomes large.

The operation panel 60 is provided on an upper part of the image forming apparatus 1. The operation panel 60 has a display unit 61 and a transmitter 62.

The display unit 61 displays various displays. "Toner improvement implementation" and the like are displayed on the display unit 61.

The transmitter 62 transmits a drive signal for starting to drive the photoconductor 110 to the drive controller 50 by being operated by an operator. The drive signal is a signal for starting to drive the photoconductor 110 without sending the sheet S to the image forming part 10.

The drive controller 50 controls a drive state of the photoconductor 110. When the drive signal is received, the drive controller 50 rotates the photoconductor 110. In the present embodiment, when the drive signal is received, the drive controller 50 drives the photoconductor 110 and the charging roller 120.

As described above, in the image forming apparatus 1 of the present embodiment, since the voltage controller 42 sets the applied voltage value V to be applied to the charging roller 120 when the sheet S has the size coming into contact with the development region S1 and the outer region S2 to be larger than the reference voltage value to be applied to the charging roller 120 when the sheet S has the size coming into contact only with the development region S1, the remaining of the toner in the outer region S2 is suppressed.

The voltage controller 42 changes the applied voltage value V to the specified voltage value V2 which is the absolute value larger than the set voltage value V1 when the sheet S has the size coming into contact with the development region S1 and the outer region S2 and when the cumulative value of the number of printed sheets of the sheet S is equal to or less than the specified value smaller than the set value. Thus, since the applied voltage value V is set to a larger value during a period in which the cumulative value becomes a relatively small specified value from the initial stage of use of the image forming apparatus 1, that is, a relatively large amount of lubricant is supplied, the remaining of the toner in the outer region S2 is more reliably suppressed.

In the image forming apparatus 1, since the drive controller 50 rotates the photoconductor 110 by the operator operating the transmitter 62, the film formed in the outer region S2 by the outer contact part 164 of the cleaning blade 160 is removed. Thus, the remaining of the toner in the outer region S2 is suppressed.

Further, since the drive controller 50 drives the photoconductor 110 and the charging roller 120 when receiving the drive signal, the surface 110S of the photoconductor 110 is maintained at an appropriate potential. The surface 110S of the photoconductor 110 is maintained at an appropriate potential, and thus, the outflow of carriers and the like in the developing device 150 is suppressed.

It should be noted that the currently disclosed embodiment is an example in all respects and is not restrictive. The scope of the present invention is illustrated by the scope of claims rather than the above description, and it is intended to include all changes within the meaning and scope equivalent to the scope of claims.

Figure 9:
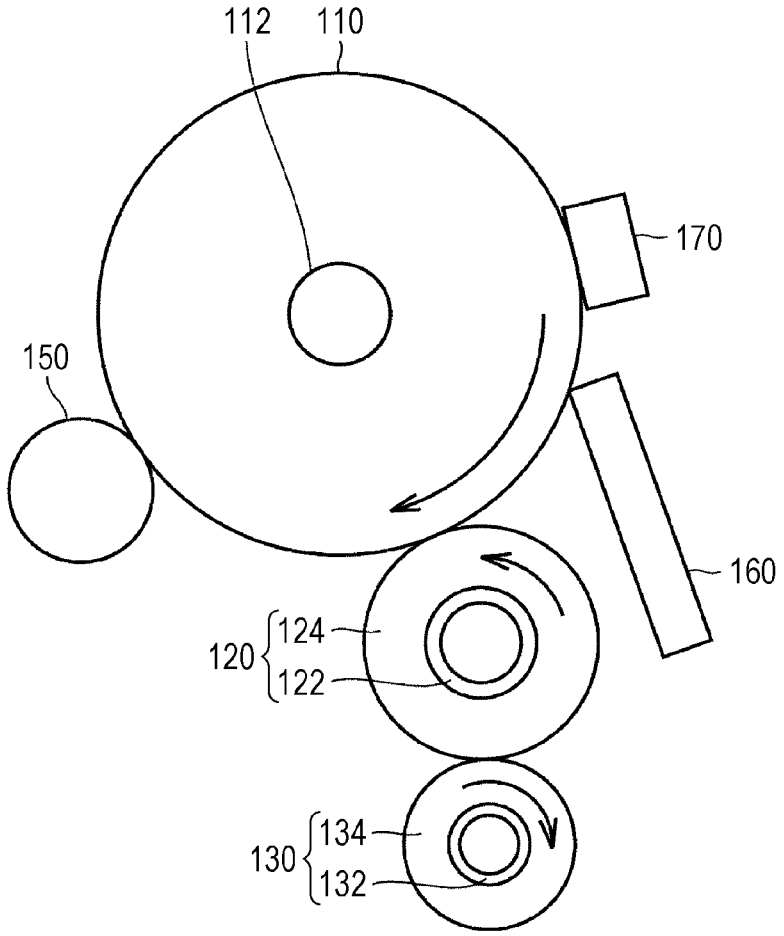
FIG. 9 is a sectional view illustrating a modification example of the arrangement of the lubricant supplier.

For example, the lubricant supplier 170 may be attached to an end of the support shaft 122 of the charging roller 120. Alternatively, as illustrated in FIG. 9, the lubricant supplier 170 may be provided so as to be pressed against a part of the outer region S2 of the photoconductor 110 on an upstream side of the cleaning blade 160. In this case, the lubricant supplier 170 may or may not rotate in response to the rotation of the photoconductor 110.

When the cumulative value of the number of printed sheets is equal to or less than the set value (NO in ST14), the voltage controller 42 may change the applied voltage value V to an intermediate value between the specified voltage value V2 and the set voltage value V1 (for example, +40 V).

Although embodiments of the present invention have been described and illustrated in detail, the disclosed embodiments are made for purposes of illustration and example only and not limitation. The scope of the present invention should be interpreted by terms of the appended claims.

What is claimed is:

1. An image forming apparatus comprising:

a photoconductor that is rotatable around a rotation shaft;

a charging roller that is disposed so as to be in contact with a surface of the photoconductor, and charges the surface of the photoconductor;

an exposure device that forms a latent image by exposing an exposure part of the surface of the photoconductor located on a downstream side of the charging roller in a rotation direction of the photoconductor;

a developing device that is provided on the downstream side of the charging roller in the rotation direction of the photoconductor, and forms a toner image by supplying toner to the latent image;

a cleaning blade that is provided between a transfer part of the surface of the photoconductor located on a downstream side of the developing device in the rotation direction of the photoconductor and the charging roller, and removes residual toner adhering to a part of the surface of the photoconductor on a downstream side of the transfer part;

a lubricant supplier that supplies a lubricant to the surface of the photoconductor; and a voltage controller that controls a charging voltage to be applied to the charging roller, wherein the surface of the photoconductor has a development region in which the toner image is formed by the developing device and an outer region located outside of the development region in an axial direction of the rotation shaft, the cleaning blade has an inner contact part that is in contact with the development region and an outer contact part that is in contact with the outer region, the lubricant supplier is capable of supplying the lubricant to at least a part of the outer region, and the voltage controller sets an applied voltage value that is an absolute value of the charging voltage to be applied to the charging roller when a sheet has a size coming into contact with the development region and the outer region to be larger than a reference voltage value that is an absolute value of the charging voltage to be applied to the charging roller when the sheet has a size coming into contact only with the development region.

2. The image forming apparatus according to claim 1, wherein the voltage controller does not control the applied voltage value when the sheet to be supplied to the transfer part has the size coming into contact only with the development region.

3. The image forming apparatus according to claim 1, wherein the voltage controller changes the applied voltage value to a set voltage value that is an absolute value larger than the reference voltage value when the sheet has the size coming into contact with the development region and the outer region and when a cumulative value of the number of printed sheets of the sheet or a cumulative value of the number of times of rotations of the photoconductor is equal to or less than a set value.

4. The image forming apparatus according to claim 3, wherein the voltage controller changes the applied voltage value to a specified voltage value that is an absolute value larger than the set voltage value when the sheet has the size coming into contact with the development region and the outer region and the cumulative value of the number of printed sheets of the sheet or the cumulative value of the number of times of rotations of the photoconductor is equal to or less than a specified value smaller than the set value.

5. An image forming apparatus comprising:

a photoconductor that is rotatable around a rotation shaft;

a charging roller that is disposed so as to be in contact with a surface of the photoconductor, and charges the surface of the photoconductor;

an exposure device that forms a latent image by exposing an exposure part of the surface of the photoconductor located on a downstream side of the charging roller in a rotation direction of the photoconductor;

a developing device that is provided on the downstream side of the charging roller in the rotation direction of the photoconductor, and forms a toner image by supplying toner to the latent image;

a cleaning blade that is provided between a transfer part of the surface of the photoconductor located on a downstream side of the developing device in the rotation direction of the photoconductor and the charging roller, and removes residual toner adhering to a part of the surface of the photoconductor on a downstream side of the transfer part;

a lubricant supplier that supplies a lubricant to the surface of the photoconductor;

a drive controller that controls a drive state of the photoconductor; and an operation panel that is capable of being operated by an operator, wherein the operation panel has a transmitter that transmits a drive signal for starting to drive the photoconductor to the drive controller by being operated by the operator, and the drive controller rotates the photoconductor when the drive signal is received.

6. The image forming apparatus according to claim 5, wherein the drive controller drives the photoconductor and the charging roller when the drive signal is received.

* * * * *